US008286893B2

(12) United States Patent
Agresta et al.

(10) Patent No.: US 8,286,893 B2
(45) Date of Patent: Oct. 16, 2012

(54) FUEL INJECTOR

(75) Inventors: Antonio Agresta, Pisa (IT); Gianbattista Fischetti, Cascina (IT); Luigi Gargiulo, Pisa (IT); Marco Mechi, Pisa (IT)

(73) Assignee: Continental Automotive GmbH, Hannover (DE)

( * ) Notice: Subject to any disclaimer, the term of this patent is extended or adjusted under 35 U.S.C. 154(b) by 392 days.

(21) Appl. No.: 12/556,691

(22) Filed: Sep. 10, 2009

(65) Prior Publication Data

US 2010/0065652 A1 Mar. 18, 2010

(30) Foreign Application Priority Data

Sep. 11, 2008 (EP) ..... 08016011

(51) Int. Cl.
*F02M 51/06* (2006.01)
*F02M 51/00* (2006.01)

(52) U.S. Cl. ..... 239/5; 239/585.1; 239/585.5; 239/590; 239/590.3

(58) Field of Classification Search ..... 239/5, 88, 239/96, 575, 584, 585.1–585.5, 590, 590.3, 239/533.2, 533.9, 533.11
See application file for complete search history.

(56) References Cited

U.S. PATENT DOCUMENTS

| | | | | |
|---|---|---|---|---|
| 7,059,548 | B2 | 6/2006 | Reiter et al. | 239/585.1 |
| 7,070,127 | B2 | 7/2006 | Maier | 239/585.1 |
| 2003/0155448 | A1 * | 8/2003 | Reiter et al. | 239/585.1 |
| 2007/0227984 | A1 | 10/2007 | Wells et al. | 210/767 |

FOREIGN PATENT DOCUMENTS

| | | |
|---|---|---|
| EP | 1741925 | 1/2007 |
| WO | 02068816 | 9/2002 |
| WO | 02090757 | 11/2002 |

OTHER PUBLICATIONS

European Search Report and Written Opinion for Application No. 08016011.2 (5 pages), Feb. 18, 2009.

* cited by examiner

*Primary Examiner* — Darren W Gorman
(74) *Attorney, Agent, or Firm* — King & Spalding L.L.P.

(57) ABSTRACT

A fuel injector (10) has a housing (12) with a central longitudinal axis (L) having a fluid inlet portion (18) being adapted to be coupled to a fuel rail at a first axial end area (20). The housing (12) has a recess (24) and enables a fluid flow through a fluid outlet portion (26) at a second axial end area (28) facing away from the first axial end area (20). The fluid inlet portion (18) communicates with the fluid outlet portion (26) via the recess (24). Furthermore, the fuel injector (10) has a safety component (30), which is arranged at the central longitudinal axis (L) within the recess (24) and adapted to reduce and arranged for reducing a velocity regarding the central longitudinal axis (L) at the fluid inlet portion (18) of the fluid flowing from the recess (24) through the fluid inlet portion (18).

14 Claims, 3 Drawing Sheets

FUEL INJECTOR

CROSS-REFERENCE TO RELATED APPLICATIONS

This application claims priority to EP Patent Application No. 08016011 filed Sep. 11, 2008, the contents of which is incorporated herein by reference in its entirety.

TECHNICAL FIELD

The invention relates to a fuel injector.

BACKGROUND

Fuel injectors are in widespread use, in particular for internal combustion engines where they may be arranged in order to dose fluid into an intake manifold of the internal combustion engine or directly into the combustion chamber of a cylinder of the internal combustion engine.

Fuel injectors are manufactured in various forms in order to satisfy the various needs for the various combustion engines. Therefore, for example, their length, their diameter, and also various elements of the fuel injector being responsible for the way the fluid is dosed may vary in a wide range. In addition to that, fuel injectors may accommodate an actuator for actuating a needle of the fuel injector, which may, for example, be an electromagnetic actuator or a piezoelectric actuator.

In order to enhance the combustion process in view of the creation of unwanted emissions, the respective fuel injector may be suited to dose fluids under very high pressures. The pressures may be in the case of a gasoline engine in the range of up to 200 bar and in the case of a diesel engine in the range of up to 2 000 bar, for example.

SUMMARY

According to various embodiments, a fuel injector can be created which facilitates a reliable operation and a safe maintenance.

According to an embodiment, a fuel injector may comprise a housing with a central longitudinal axis having a fluid inlet portion being adapted to be coupled to a fuel rail at a first axial end area, the housing comprising a recess and enabling a fluid flow through a fluid outlet portion at a second axial end area facing away from the first axial end area, wherein the fluid inlet portion communicates with the fluid outlet portion via the recess, and a safety component being arranged at the central longitudinal axis within the recess and being adapted to reduce and arranged for reducing a velocity regarding the central longitudinal axis at the fluid inlet portion of the fluid flowing from the recess through the fluid inlet portion.

According to a further embodiment, the safety component can be adapted to maintain and is arranged for maintaining the most part of a velocity regarding the central longitudinal axis of the fluid flowing from the fluid inlet portion to the fluid outlet portion. According to a further embodiment, the safety component may comprise at least one cavity, the cavity comprising at least one horizontal part and at least one vertical part regarding the central longitudinal axis. According to a further embodiment, the safety component may comprise four cavities being arranged vertically regarding the central longitudinal axis and a cross section of the safety component is at least partly cross-shaped, the cross-shaped cross section aligning with the four cavities regarding the direction of the central longitudinal axis and being arranged with a given axial offset to the four cavities regarding the central longitudinal axis via a central part of the safety component. According to a further embodiment, the safety component may comprise steel. According to a further embodiment, the safety component may comprise stainless steel. According to a further embodiment, the safety component may comprise plastic. According to a further embodiment, the safety component may be fixed to a part of the housing.

BRIEF DESCRIPTION OF THE DRAWINGS

Exemplary embodiments are explained in the following with the aid of schematic drawings. These are as follows.

DETAILED DESCRIPTION

Figure 1:
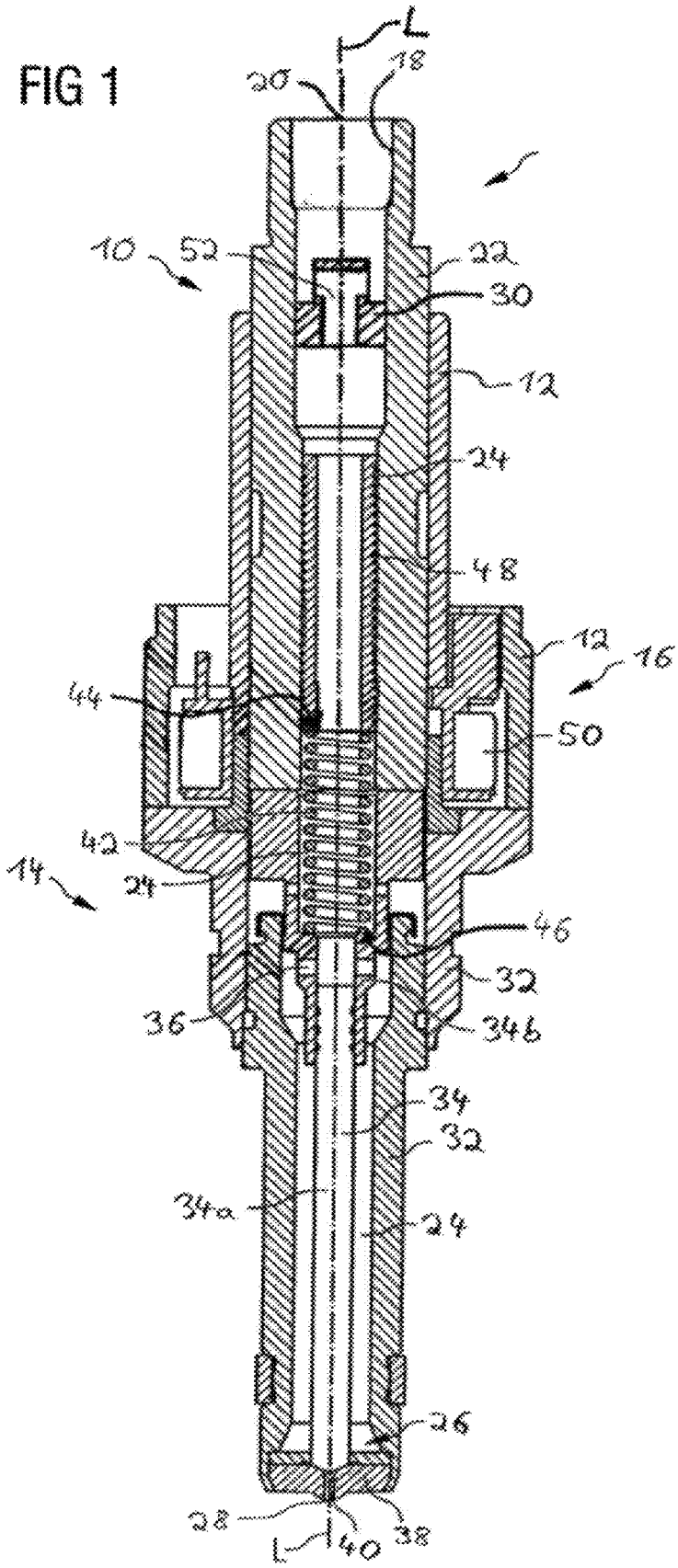
FIG. 1 a fuel injector in a longitudinal section view with a first embodiment of a safety component, FIGS. 2A and 2B the first embodiment of the safety component, FIG. 3 a part of the fuel injector in a sectional view with a second embodiment of the safety component, and FIGS. 4A and 4B the second embodiment of the safety component.

According to various embodiments, a fuel injector may comprise a housing with a central longitudinal axis having a fluid inlet portion being adapted to be coupled to a fuel rail at a first axial end area, the housing comprising a recess and enabling a fluid flow through a fluid outlet portion at a second axial end area facing away from the first axial end area, wherein the fluid inlet portion communicates with the fluid outlet portion via the recess. Moreover, the fuel injector comprises a safety component being arranged at the central longitudinal axis within the recess and being adapted to reduce and arranged for reducing a velocity regarding the central longitudinal axis at the fluid inlet portion of the fluid flowing from the recess through the fluid inlet portion.

This has the advantage that a safe maintenance of the fuel injector is enabled. Preferably, the safety component is used for injectors working at high temperature, for example at 100° Celsius. In particular, the safety component is adapted to reduce and arranged for reducing the velocity of the fluid spitting from the recess through the fluid inlet portion due to pressure drop after dismounting the fuel injector from the fuel rail for maintenance and thereby enabling the safe maintenance of the fuel injector. In particular, the safety component is a separate element. For example, the safety component is adapted to change and arranged for changing intensity and/or distribution and/or direction of the velocity regarding the central longitudinal axis at the fluid inlet portion of the fluid flowing from the recess through the fluid inlet portion. Preferably, the safety component is adapted to reduce and arranged for reducing an average velocity regarding a cross sectional area of the recess at the fluid inlet portion of the fluid flowing from the recess through the fluid inlet portion. The safety component preferably changes flow field and flow behavior regarding the central longitudinal axis at the fluid inlet portion of the fluid flowing from the recess through the fluid inlet portion. Preferably, the safety component is arranged regarding the central longitudinal axis inside an inlet tube of the housing in an area close to the fluid inlet portion. Preferably, the safety component is arranged regarding the central longitudinal axis still having a small distance to the fluid inlet portion. In particular, the safety component is arranged regarding the central longitudinal axis within the recess in an area of constant flow velocity. Preferably, the axial positioning of the safety component regarding the central longitudinal axis is not limited but the safety component is arranged such that there is no area of acceleration of the fluid flow regarding the central longitudinal axis between the safety component and the first axial end area of the housing. For example, such an area of acceleration of the fluid flow would be a reducing diameter of the recess.

For example, the safety component is arranged at the central longitudinal axis within the recess with a distance of nearly 5 cm to the fluid inlet portion. Preferably, the safety component may be arranged within the recess without the need of orienting it. Preferably, the safety component is at least partly cylindrically shaped. In particular, the dimensions such as the diameter of the safety component are adjusted to the dimensions, for example the diameter, of the recess of the housing. For example, the safety component is manufactured by milling from a single piece.

In an embodiment the safety component is adapted to maintain and is arranged for maintaining the most part of a velocity regarding the central longitudinal axis of the fluid flowing from the fluid inlet portion to the fluid outlet portion.

Thus, a reliable operation of the fuel injector is enabled. In particular, the safety component is adapted to contribute to an insignificant pressure loss of the fuel flowing from the fluid inlet portion to the fluid outlet portion during actuation of the fuel injector.

In a further embodiment the safety component comprises at least one cavity, the cavity comprises at least one horizontal part and at least one vertical part regarding the central longitudinal axis.

Therefore, the safety component is adapted to reduce and arranged for reducing the velocity of the fluid spitting through the fluid inlet portion in an especially reliable way. Moreover, the safety component is adapted to contribute to an insignificant pressure loss of the fuel flowing from the fluid inlet portion to the fluid outlet portion during actuation of the fuel injector in an especially reliable way. Preferably, the horizontal part of the cavity faces the fluid inlet portion and the vertical part of the cavity faces the fluid outlet portion. Preferably, the vertical part of the cavity is centered within the safety component. Preferably, the cavity is T-shaped comprising one horizontal part and one vertical part regarding the central longitudinal axis. For example, the cavity of the safety component is manufactured by drilling.

In a further embodiment the safety component comprises four cavities being arranged vertically regarding the central longitudinal axis and a cross section of the safety component is at least partly cross-shaped, the cross-shaped cross section aligning with the four cavities regarding the direction of the central longitudinal axis and being arranged with a given axial offset to the four cavities regarding the central longitudinal axis via a central part of the safety component.

Therefore, the safety component is adapted to reduce and arranged for reducing the velocity of the fluid spitting through the fluid inlet portion in an especially reliable way. Moreover, the safety component is adapted to contribute to an insignificant pressure loss of the fuel flowing from the fluid inlet portion to the fluid outlet portion during actuation of the fuel injector in an especially reliable way. Preferably, the four cavities are arranged facing the fluid inlet portion being equally distanced regarding a perimeter of the safety component. Thus, the fluid flow from the fluid inlet portion to the fluid outlet portion through each of the cavities along the central longitudinal axis is diverted by the cross-shaped cross section aligning with the four cavities regarding the central longitudinal axis.

Alternatively, the safety component may comprise three cavities being arranged vertically regarding the central longitudinal axis, wherein the cross shaped cross section of the safety component is adapted to the number of the cavities such that the cross section aligns with the cavities regarding the direction of the central longitudinal axis. Alternatively, the safety component may comprise at least five cavities being arranged vertically regarding the central longitudinal axis, wherein the cross shaped cross section of the safety component is adapted to the number of the cavities such that the cross section aligns with the cavities regarding the direction of the central longitudinal axis.

In a further embodiment the safety component comprises steel.

Thus, the safety component may enable low production costs. Moreover, the safety component may be easy to be manufactured. By using steel, thermal stress within the safety component may be limited or prevented. Furthermore, the fluid flowing within the recess may not be contaminated by particle loss due to collisions or wear of the safety component.

In a further embodiment the safety component comprises stainless steel.

Thus, the safety component may enable low production costs. Moreover, the safety component may be easy to be manufactured. By using stainless steel, thermal stress within the safety component may be limited or prevented.

In a further embodiment the safety component comprises plastic.

Thus, the safety component may enable low production costs. Moreover, the safety component may be easy to be manufactured. By using plastic, thermal stress within the safety component may be limited or prevented. Furthermore, the fluid flowing within the recess may not be contaminated by particle loss due to collisions or wear of the safety component.

In a further embodiment the safety component is fixed to a part of the housing.

Thus, a reliable coupling of the safety component to the housing may be enabled. Moreover, the safety component may be easy to be manufactured. Preferably, the safety component is fixed to the inlet tube of the housing by press fitting. Therefore, the assembling of the safety component to the housing can be performed with a single press fitting without orienting the safety component. Thus, low production costs of the fuel injector may be enabled.

Elements of the same design and function that appear in different illustrations are identified with the same reference characters.

A fuel injector 10 (FIG. 1) may be used as a fuel injection valve for a combustion chamber of an internal combustion engine and comprises a housing 12 with a valve assembly 14, an actuator unit 16 and a fluid inlet portion 18. The housing 12 is adapted to be coupled to a fuel rail at a first axial end area 20 of the housing 12 via the fluid inlet portion 18, wherein the fuel rail is designed to be connected to a high-pressure fuel chamber of the internal combustion engine, the fuel is stored under high pressure, for example, under the pressure of about 200 bar in the case of a gasoline engine or of about 2000 bar in the case of a diesel engine.

The housing 12 with a central longitudinal axis L comprises an inlet tube 22 with a recess 24 which is axially led through the housing 12. The housing 12 being adapted to be coupled to a fuel rail at the first axial end area 20 enables a fluid flow through a fluid outlet portion 26 at a second axial end area 28 facing away from the first axial end area 20. The fluid inlet portion 18 communicates with the fluid outlet portion 26 via the recess 24.

A safety component 30 is arranged at the central longitudinal axis L within the recess 24 preferably in an area close to the fluid inlet portion 18. For example, the safety component 30 is arranged at the central longitudinal axis L within the recess 24 with a distance of up to 5 cm to the fluid inlet portion 18. Preferably, the safety component 30 is arranged regarding the central longitudinal axis L still having a small distance to the fluid inlet portion 18. Preferably, the safety component 30 is arranged at the central longitudinal axis L within the recess 24 in an axial end area of the inlet tube 22, which faces away from the fluid inlet portion 18. The safety component 30 is adapted to reduce and arranged for reducing a velocity regarding the central longitudinal axis L at the fluid inlet portion 18 of the fluid flowing from the recess 24 through the fluid inlet portion 18. In particular, the safety component 30 is adapted to reduce and arranged for reducing the velocity of the fluid spitting from the recess 24 through the fluid inlet portion 18 due to pressure drop after dismounting the fuel injector 10 from the fuel rail for maintenance and thereby enabling the safe maintenance of the fuel injector 10. For example, the safety component 30 is adapted to change and arranged for changing intensity and/or distribution and/or direction of the velocity regarding the central longitudinal axis L at the fluid inlet portion 18 of the fluid flowing from the recess 24 through the fluid inlet portion 18. For instance, a portion of the velocity along the central longitudinal axis L of the fluid flow from the recess 24 through the fluid inlet portion 18 is reduced by the safety component 30 at the fluid inlet portion 18. Preferably, the safety component 30 is adapted to maintain and is arranged for maintaining the most part of a velocity regarding the central longitudinal axis L of the fluid flowing from the fluid inlet portion 18 to the fluid outlet portion 26.

The housing 12 comprises a valve body 32. A valve needle 34 is arranged within the housing 12 axially movable in the recess 24 facing the fluid outlet portion 26. The valve needle 34 comprises an end section 34*a* and an armature 34*b*. Alternatively, the valve needle 34 may be made in one piece or the valve needle 34 may comprise further parts. The armature 34*b* is fixed to the end section 34*a* of the valve needle 34. The armature 34*b* has openings 36 which couple an upper part of the recess 24 and a lower part of the recess 24 hydraulically. The recess 24 and the openings 36 are parts of a main fluid line which allows the fluid flow from the fluid inlet portion 18 to the fluid outlet portion 26.

The fluid outlet portion 26 is closed or opened depending on the axial position of the valve needle 34. In a closing position of the valve needle 34 it rests sealingly on a seat 38 thereby preventing a fluid flow through at least one injection nozzle 40 in the valve body 32. The injection nozzle 40 may be for example an injection hole, but it may also be of some other type suitable for dosing fluid. The seat 38 may be made in one part with the valve body 32 or may also be a separate part from the valve body 32.

A spring 42 is arranged within the recess 24 and is adapted to exert and arranged for exerting a spring force on the valve needle 34 along the central longitudinal axis L in such a way as to contribute to prevent the fluid flow through the fluid outlet portion 26. The spring 42 is arranged to rest on a first spring rest 44 and a second spring rest 46, which is for example the armature 34*b* of the valve needle 34. By this, the spring 42 is mechanically coupled to the valve needle 34.

A calibration tube 48 is arranged in the recess 24 facing the fluid inlet portion 18 and may be moved axially during the manufacturing process of the fuel injector 10 in order to preload the spring 42 in a desired way.

The fuel injector 10 is provided with a drive that is preferably an electromagnetic drive, comprising a coil 50, which is preferably extrusion-coated, the valve body 32, the armature 34*b* and the inlet tube 22 all forming an electromagnetic circuit. The armature 34*b* preferably has a large diameter compared to the diameter of the end section 34*a* of the valve needle 34. The large diameter enables a proper electromagnetic flow through the armature 34*b* which contributes to a proper controllability of the end section 34*a* of the valve needle 34.

If the coil 50 is energized, this results in an electromagnetic force acting on the valve needle 34. The electromagnetic force acts against the mechanical force obtained from the spring 42. By appropriately energizing the coil 50, the valve needle 34, in particular the end section 34*a* of the valve needle 34, may in that way be moved away from its closing position, which results in a fluid flow through the injection nozzle 40. After a predetermined time the coil 50 may be de-energized again.

The fluid may flow from the fluid inlet portion 18 through the upper part of the recess 24 of the inlet tube 22, the safety component 30, the calibration tube 48, the openings 36 in the armature 34*b* and the lower part of the recess 24 to the fluid outlet portion 26. If the valve needle 34 allows a fluid flow through the fluid outlet portion 26 in an opening position, the fluid may flow through the injection nozzle 40.

Preferably, the safety component 30 is fixed to the inlet tube 22 of the housing 12. Thus, a reliable coupling of the safety component 30 to the housing 12 may be enabled. For example, the safety component 30 is fixed to the housing 12 by press fitting. Therefore, the assembling of the safety component 30 to the inlet tube 22 of the housing 12 can be performed with a single press fitting without orienting the safety component 30. Thus, low production costs of the fuel injector 10 may be enabled. Preferably, the safety component 30 is at least partly cylindrically shaped. In particular, the dimensions such as the diameter of the safety component 30 are adjusted to the dimensions, for example the diameter, of the recess 24 of the housing 12.

For example, the safety component 30 is manufactured by milling from a single piece. For example, the safety component 30 comprises steel, for instance stainless steel. Alternatively, the safety component 30 may comprise plastic. Thus, the safety component 30 may enable low production costs and may be easy to be manufactured. Furthermore, thermal stress within the safety component 30 may be limited or prevented.

Figure 2A:
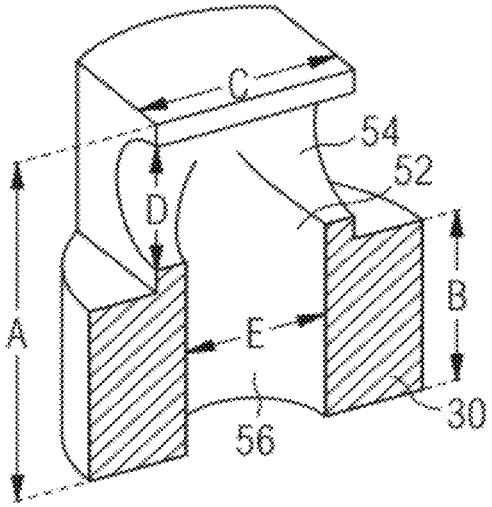
Figure 2B:
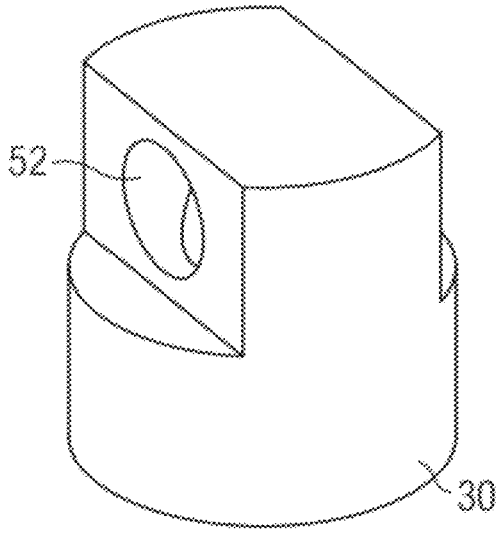

The safety component 30 comprises at least one cavity 52. For example, the cavity 52 of the safety component 30 is manufactured by drilling. In a first embodiment of the safety component 30 (FIGS. 2A and 2B), the cavity 52 comprises at least one horizontal part 54 and at least one vertical part 56 regarding the central longitudinal axis L. For example, the cavity 52 comprises one horizontal part 54 and one vertical part 56 regarding the central longitudinal axis L.

For example, in the first embodiment the safety component 30 has an axial length A of about 6 mm (FIG. 2A), a first length B of about 3 mm, a second length C of about 3.2 mm, a diameter of the horizontal part of the cavity D of about 2.2 mm and a diameter of the vertical part of the cavity E of about 2.1 mm.

Figure 3:
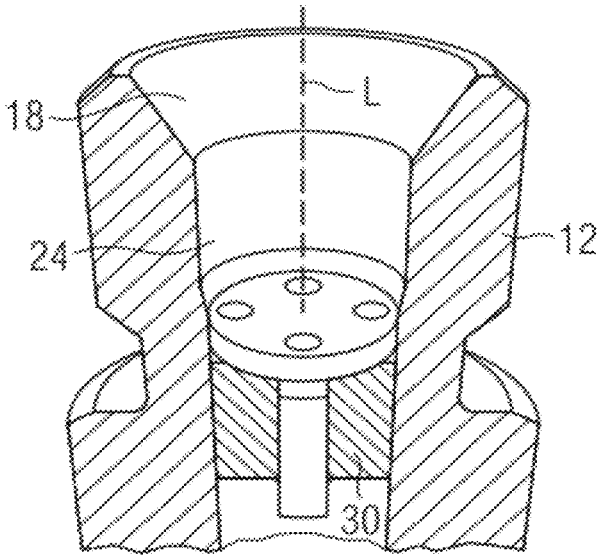

FIG. 3 shows a part of the fuel injector 10 in a sectional view with a second embodiment of the safety component 30. The housing 12 with the central longitudinal axis L comprises the fluid inlet portion 18 and the recess 24. The safety component 30 is arranged at the central longitudinal axis L within the recess 24 in an area close to the fluid inlet portion 18.

For example, the safety component 30 is arranged at the central longitudinal axis L within the recess 24 with a distance of up to 5 cm to the fluid inlet portion 18. Preferably, the safety component 30 is arranged regarding the central longitudinal axis L still having a small distance to the fluid inlet portion 18. Preferably, the safety component 30 is arranged at the central longitudinal axis L within the recess 24 in an axial end area of the inlet tube 22 (FIG. 1), which faces away from the fluid inlet portion 18. The safety component 30 is adapted to reduce and arranged for reducing a velocity regarding the central longitudinal axis L at the fluid inlet portion 18 of the fluid flowing from the recess 24 through the fluid inlet portion 18. In particular, the safety component 30 is adapted to reduce and arranged for reducing the velocity of the fluid spitting from the recess 24 through the fluid inlet portion 18 due to pressure drop after dismounting the fuel injector 10 from the fuel rail for maintenance and thereby enabling the safe maintenance of the fuel injector 10. For example, the safety component 30 is adapted to change and arranged for changing intensity and/or distribution and/or direction of the velocity regarding the central longitudinal axis L at the fluid inlet portion 18 of the fluid flowing from the recess 24 through the fluid inlet portion 18. For instance, a portion of the velocity along the central longitudinal axis L such as the axial velocity of the fluid flow from the recess 24 through the fluid inlet portion 18 is reduced by the safety component 30 at the fluid inlet portion 18. Preferably, the safety component 30 is adapted to maintain and is arranged for maintaining the most part of a velocity regarding the central longitudinal axis L such as the axial velocity of the fluid flowing from the fluid inlet portion 18 to the fluid outlet portion 26 (FIG. 1).

Figure 4A:
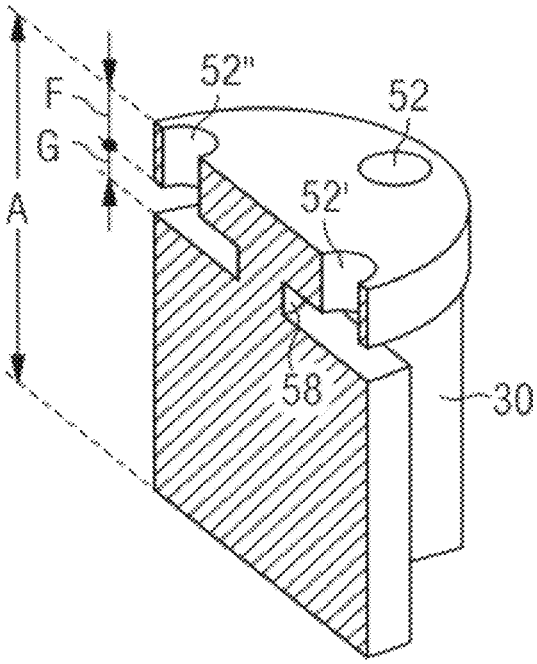
Figure 4B:
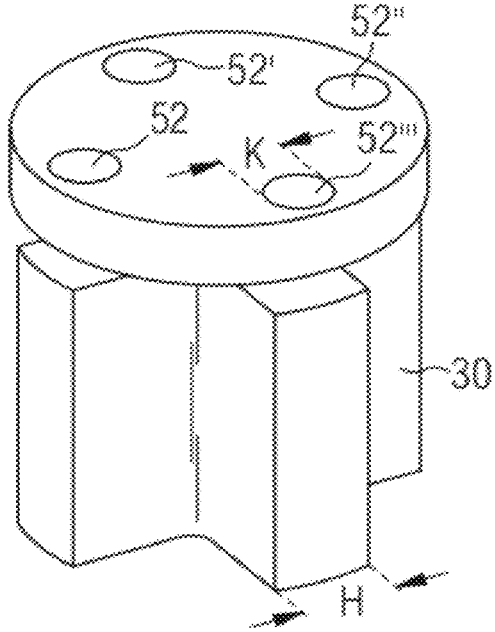

In the second embodiment of the safety component 30 (FIG. 4A and 4B), the safety component 30 comprises four cavities 52, 52', 52", 52'" which are arranged vertically regarding the central longitudinal axis L. A cross section of the safety component 30 is at least partly cross-shaped. The cross-shaped cross section aligns with the four cavities 52, 52', 52", 52'" regarding the direction of the central longitudinal axis L and is arranged with a given axial offset to the four cavities 52, 52', 52", 52'" regarding the central longitudinal axis L via a central part 58 of the safety component 30. Thus, the safety component 30 is adapted to reduce and arranged for reducing the velocity of the fluid spitting through the fluid inlet portion 18 in an especially reliable way.

For example, in the second embodiment the safety component 30 has an axial length A of about 6 mm (FIG. 4A), a third length F of about 1 mm, a fourth length G of about 0.5 mm, a fifth length H of about 0.5 mm (FIG. 4B) and a diameter of each of the four cavities K of about 1.0 mm.

The invention is not restricted by the explained embodiments. For example, the safety component 30 may comprise a different shape or may be arranged at a different place within the fuel injector 10. Furthermore, the cavity 52 of the safety component 30 and/or the cross section of the safety component 30 and/or the recess 24 of the housing 12 may comprise a different shape.

What is claimed is:

1. A fuel injector comprising a housing with a central longitudinal axis having a fluid inlet portion being adapted to be coupled to a fuel rail at a first axial end area, the housing comprising a recess and enabling a fluid flow through a fluid outlet portion at a second axial end area facing away from the first axial end area, wherein the fluid inlet portion communicates with the fluid outlet portion via the recess, and a safety component being arranged at the central longitudinal axis within the recess and being adapted to reduce and arranged for reducing a velocity regarding the central longitudinal axis at the fluid inlet portion of the fluid flowing from the recess through the fluid inlet portion;

wherein the safety component comprises a plurality of cavities being arranged vertically regarding the central longitudinal axis and a cross section of the safety component is at least partly to align with the plurality of cavities regarding the direction of the central longitudinal axis and being arranged with a given axial offset to the plurality of cavities regarding the central longitudinal axis via a central part of the safety component.

2. The fuel injector according to claim 1, wherein the safety component is adapted to maintain and is arranged for maintaining the most part of a velocity regarding the central longitudinal axis of the fluid flowing from the fluid inlet portion to the fluid outlet portion.

3. A fuel injector, comprising:

a housing with a central longitudinal axis having a fluid inlet portion being adapted to be coupled to a fuel rail at a first axial end area, the housing comprising a recess and enabling a fluid flow through a fluid outlet portion at a second axial end area facing away from the first axial end area, wherein the fluid inlet portion communicates with the fluid outlet portion via the recess, and a safety component being arranged at the central longitudinal axis within the recess and being adapted to reduce and arranged for reducing a velocity regarding the central longitudinal axis at the fluid inlet portion of the fluid flowing from the recess through the fluid inlet portion;

wherein the safety component comprises four cavities being arranged vertically regarding the central longitudinal axis and a cross section of the safety component is at least partly cross-shaped, the cross-shaped cross section aligning with the four cavities regarding the direction of the central longitudinal axis and being arranged with a given axial offset to the four cavities regarding the central longitudinal axis via a central part of the safety component.

4. The fuel injector according to claim 1, wherein the safety component comprises steel.

5. The fuel injector according to claim 4, wherein the safety component comprises stainless steel.

6. The fuel injector according to claim 1, wherein the safety component comprises plastic.

7. The fuel injector according to claim 1, wherein the safety component is fixed to a part of the housing.

8. A method for operating a fuel injector comprising coupling a fluid inlet portion of a housing having a central longitudinal axis to a fuel rail at a first axial end area, enabling a fluid flow through a fluid outlet portion at a second axial end area facing away from the first axial end area, wherein the fluid inlet portion communicates with the fluid outlet portion via a recess in the housing, and arranging a safety component at the central longitudinal axis within the recess and being adapted to reduce and arranged for reducing a velocity regarding the central longitudinal axis at the fluid inlet portion of the fluid flowing from the recess through the fluid inlet portion;

wherein the safety component comprises a plurality of cavities being arranged vertically regarding the central longitudinal axis and a cross section of the safety component aligning with the plurality of cavities regarding the direction of the central longitudinal axis and being arranged with a given axial offset to the plurality of cavities regarding the central longitudinal axis via a central part of the safety component.

9. The method according to claim 8, wherein the safety component is adapted to maintain and is arranged for maintaining the most part of a velocity regarding the central longitudinal axis of the fluid flowing from the fluid inlet portion to the fluid outlet portion.

10. A method for operating a fuel injector comprising coupling a fluid inlet portion of a housing having a central longitudinal axis to a fuel rail at a first axial end area, enabling a fluid flow through a fluid outlet portion at a second axial end area facing away from the first axial end area, wherein the fluid inlet portion communicates with the fluid outlet portion via a recess in the housing, and arranging a safety component at the central longitudinal axis within the recess and being adapted to reduce and arranged for reducing a velocity regarding the central longitudinal axis at the fluid inlet portion of the fluid flowing from the recess through the fluid inlet portion;

wherein the safety component comprises four cavities being arranged vertically regarding the central longitudinal axis and a cross section of the safety component is at least partly cross-shaped, the cross-shaped cross section aligning with the four cavities regarding the direction of the central longitudinal axis and being arranged with a given axial offset to the four cavities regarding the central longitudinal axis via a central part of the safety component.

11. The method according to claim 8, wherein the safety component comprises steel.

12. The method according to claim 11, wherein the safety component comprises stainless steel.

13. The method according to claim 8, wherein the safety component comprises plastic.

14. The method according to claim 8, wherein the safety component is fixed to a part of the housing.

* * * * *